US007438456B2

(12) United States Patent
Oyama

(10) Patent No.: US 7,438,456 B2
(45) Date of Patent: Oct. 21, 2008

(54) VEHICLE HEADLIGHT

(75) Inventor: Hiroo Oyama, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 11/769,880

(22) Filed: Jun. 28, 2007

(65) Prior Publication Data

US 2008/0002419 A1 Jan. 3, 2008

(30) Foreign Application Priority Data

Jun. 28, 2006 (JP) ..... 2006-178832

(51) Int. Cl.
*F21V 33/00* (2006.01)

(52) U.S. Cl. ..... 362/517; 362/516; 362/538; 362/539; 362/346; 362/298

(58) Field of Classification Search ..... 362/346, 362/297, 298, 516, 517, 518, 538, 539, 507
See application file for complete search history.

(56) References Cited

U.S. PATENT DOCUMENTS

2004/0246738 A1* 12/2004 Taniuchi ..... 362/509
2007/0127255 A1* 6/2007 Oyama ..... 362/517

FOREIGN PATENT DOCUMENTS

JP 6203612 7/1994
JP 2001006409 1/2001

* cited by examiner

*Primary Examiner*—Laura Tso
(74) *Attorney, Agent, or Firm*—Cermak Kenealy & Vaidya LLP

(57) ABSTRACT

A vehicle headlight can project a low beam and a high beam in a reasonable and efficient fashion and does not require a maximum output during high beam illumination, which is low in frequency of use. A light source can be arranged so that a main optical axis thereof forms an angle of approximately 30° to 60° with respect to a front-to-back direction of a vehicle/vehicle headlight. An extremity of the light source can extend toward the front and side of the vehicle. Part of a first reflector can be arranged closer to the front and a center of the vehicle than the light source. A second reflector can be configured to collect light from the first reflector and reflect the same light to the front of the vehicle. The second reflector can be located behind and closer to the side of the vehicle than the light source is. A distribution pattern switching unit can be located between the first reflector and the second reflector. The first reflector and the second reflector can be configured to provide a maximum output during low beam illumination. Part of the light from the first reflector that is to be projected to the lower half of the low beam distribution pattern during low beam illumination can be reflected by a reflecting plate of the distribution pattern switching unit and projected towards a location above a horizontal level during high beam illumination.

18 Claims, 8 Drawing Sheets

VEHICLE HEADLIGHT

This application claims the priority benefit under 35 U.S.C. § 119 of Japanese Patent Application No. 2006-178832 filed on Jun. 28, 2006, which is hereby incorporated in its entirety by reference.

BACKGROUND

1. Technical Field

The presently disclosed subject matter relates to a vehicle headlight which is arranged to wrap around from the front to a side of a vehicle. Furthermore, the presently disclosed subject matter relates to a vehicle headlight which can project a low beam and a high beam in a consistent and efficient fashion and can utilize the light projected from a light source more effectively than in conventional cases.

2. Description of the Related Art

In view of improved distant visibility, it has been desirable for conventional vehicle headlights to use a reflector having high collecting power. This, however, entails greater depth dimensions and lateral width dimensions for the vehicle headlights.

In the meantime, the space at both sides of the vehicle (vehicle compartment space) for use in placing vehicle headlights has recently tended to decrease. Downsizing the vehicle headlights in the depth dimensions and lateral width dimensions in terms of the effective use rate for the vehicle compartment space sometimes dictates that the reflectors in use be smaller. In such cases, the resulting vehicle headlights may have insufficient collecting power and poor distant visibility.

There has been a demand for vehicle headlights to have the capability of distributing light to a side of the vehicle so that the light illumination covers a certain range from a roadway shoulder to a sidewalk and the like. Nevertheless, conventional vehicle headlights have only been capable of providing an insufficient light distribution to sides of vehicles.

Conventional vehicle headlights have also had the problem that when the vehicle headlights are viewed from the front of the vehicle, the corners of the vehicle headlights are not filled with the illumination light, i.e., the corners drop in luminance. Those areas thus appear dark.

In order to improve the side distribution characteristics, there are known vehicle headlights that are arranged to wrap around from the front to a side of a vehicle, such as described in Japanese Patent Application Laid-Open No. 2001-6409. These vehicle headlights have external shapes conforming to the shapes of vehicles, with the sideways light distribution characteristics secured.

The vehicle headlight described above also has a hood unit which blocks light that is projected above a horizontal level. The blocking of such light can prevent the light that is projected upward and in front of the vehicle from creating dazzling light to oncoming drivers, pedestrians, and the like. Put another way, however, this configuration cannot effectively use the light that is projected from the light source that is directed upward in front of the vehicle. The vehicle headlight described in the foregoing Japanese patent application publication also has a distribution pattern switching unit for switching between a low beam distribution pattern and a high beam distribution pattern for light illumination.

Typical vehicle headlights, including those disclosed in the above publication, are designed to provide their maximum output during high beam illumination. When selecting the low beam illumination, such conventional vehicle headlights as described above, can form the low beam distribution pattern by blocking the upward forward illumination light.

Accordingly, the conventional vehicle headlights, make no use of the blocked upward forward illumination light during low beam illumination. That portion of blocked light is designed for the maximum output during the high beam illumination. Equivalently, the conventional vehicle headlights including those disclosed in the above publication can switch between a low beam distribution pattern and a high beam distribution pattern for light illumination, but cannot project a low beam and a high beam in a reasonable or efficient fashion.

SUMMARY

In view of the foregoing characteristics, features and problems, the presently disclosed subject matter can include a vehicle headlight capable of projecting a low beam and a high beam in a reasonable and efficient fashion.

More specifically, the presently disclosed subject matter can include a vehicle headlight which can project a low beam and a high beam in a more reasonable fashion than in such a light configuration in which a maximum output is obtained during high beam illumination mode, which mode is not frequently used.

To be yet more specific, the presently disclosed subject matter can include a vehicle headlight which can use light projected from a light source more effectively than in the case of typical lights that block light that is projected from the light source and directed above a horizontal level in front of the vehicle headlight.

In a vehicle headlight according to one aspect of the presently disclosed subject matter, the light source can be arranged so that the main optical axis of the light source forms an angle of approximately 30° to 60° with respect to the front-to-back direction of the vehicle, with the extremity of the light source extending toward the front and side of the vehicle. In particular, the vehicle headlight according to this aspect can use a light source having a predetermined length in the direction of its main optical axis, such as a high-intensity discharge lamp (HID) and can be arranged such that the light source forms a predetermined angle with respect to the front-to-back direction of the vehicle.

The vehicle headlight according to the above-described aspect of the presently disclosed subject matter can include a first reflector having an elliptic reflecting surface which is arranged closer to the front and the center of the vehicle than the light source is so that a tangential line of part of the horizontal profile curve of the elliptic reflecting surface is substantially in parallel with the main optical axis of the light source and the light source falls on or near the first focus of the elliptic reflecting surface.

Further to this, according to another aspect of the presently disclosed subject matter, a vehicle headlight can include a second reflector having a reflecting surface for collecting light from the first reflector and reflecting the same to the front of the vehicle, and the second reflector can be arranged behind and closer to the side of the vehicle than the light source.

Furthermore, according to yet another aspect of the presently disclosed subject matter, a vehicle headlight can include a distribution pattern switching unit for switching a distribution pattern of the light to be projected from the second reflector between a low beam distribution pattern and a high beam distribution pattern, and the distribution pattern switching unit can be arranged between the first reflector and the second reflector.

The elliptic reflecting surface of the first reflector and the reflecting surface of the second reflector can be configured to provide a maximum output during low beam illumination, and not to provide the maximum output during high beam illumination.

In particular, the light projected from the light source towards a location above the horizontal level in front of the vehicle headlight is not blocked by, for example, a hood unit or the like, but is projected in a direction of projection of the vehicle headlight via the elliptic reflecting surface of the first reflector and the reflecting surface of the second reflector. That is, the vehicle headlight can make effective use of the light that is projected from the light source towards a direction above the horizontal level in front of the vehicle headlight.

In addition to this, the distribution pattern switching unit can be provided with a reflecting portion for reflecting part of the light from the first reflector that is to be projected to the lower half of the low beam distribution pattern during low beam illumination.

In accordance with another aspect of the presently disclosed subject matter, part of the light from the first reflector that is to be projected to the lower half of the low beam distribution pattern during low beam illumination can be reflected by the reflecting portion of the distribution pattern switching unit and projected to a direction above the horizontal level during high beam illumination.

In other words, the vehicle headlight can be configured to take into account the fact that the frequency of use of the light in low beam mode is typically higher than that of the light in high beam mode. The elliptic reflecting surface of the first reflector and the reflecting surface of the second reflector are thus configured to provide the maximum output during low beam illumination, and part of the light that is to be projected toward a direction below the horizontal level during low beam illumination is reflected and projected above the horizontal level during high beam illumination. Consequently, it is possible to project a low beam and a high beam in a more reasonable and efficient fashion as compared to lamp configurations in which a maximum output is obtained during high beam illumination (which is low in frequency of use).

In particular, the vehicle headlight according to an aspect of the presently disclosed subject matter can use the light projected from the light source more effectively than in the case of blocking the light that is projected from the light source that is directed to a location above the horizontal level in front of the vehicle headlight.

According to another aspect of the presently disclosed subject matter can, a vehicle headlight can include an inner lens for diffusing light from the light source. It is therefore possible to diffuse the light to be projected in the direction of projection of the vehicle headlight to a greater extent than that without the inner lens, and thus it is possible to project high intensity light to a side of the vehicle.

The inner lens can be arranged so that refracted light is diffused by the inner lens and projected in a direction of projection of the vehicle headlight, and reflection light reflected by the inner lens is diffused and projected in the direction of projection of the vehicle headlight.

In other words, the reflection light that is reflected by the incident surface and the exit surface of the inner lens and the refracted light that passes through the inner lens to be diffused from the exit surface of the inner lens are both projected in the direction of projection of the vehicle headlight.

Consequently, as compared to the case of projecting only the refracted light that passes through the inner lens to the direction of projection of the vehicle headlight, the vehicle headlight can increase the angle of diffusion of the light to be projected in the direction of projection of the vehicle headlight and improve the use efficiency of the light as well.

According to still another aspect of the presently disclosed subject matter, the vehicle headlight can include a third reflector having an elliptic reflecting surface which is arranged between the first reflector and the second reflector. The third reflector can be arranged so that the light source falls on or near the first focus of the elliptic reflecting surface of the third reflector.

Moreover, the light from the third reflector is first collected at the second focus of the elliptic reflecting surface of the same, and then diffused before passing through the inner lens. In other words, the light from the light source is once collected before passing through the inner lens.

In a vehicle headlight according to still another aspect of the presently disclosed subject matter, it is possible to increase the angular range of diffusion of the light that is to be projected in the direction of projection of the vehicle headlight as compared to the case where the light from the light source is not collected before passing through the inner lens.

The vehicle headlight can include a fourth reflector for reflecting the direct light from the light source into the direction of projection of the vehicle headlight. The fourth reflector can be arranged closer to the center of the vehicle than is the first reflector. A gap for letting direct light from the light source pass through is formed between the first reflector and the fourth reflector.

In other words, part of the light emitted from the light source passes through the gap formed between the first reflector and the fourth reflector, and is projected in the direction of projection of the vehicle headlight as diffusion light via only a single reflection by the fourth reflector.

Consequently, as compared to the case where all the light emitted from the light source is reflected twice or more before being projected in the direction of projection of the vehicle headlight, the vehicle headlight with the above-described first and fourth reflectors can reduce reflection-based loss in light intensity and can thus project bright light in the direction of projection of the vehicle headlight.

BRIEF DESCRIPTION OF THE DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

Figure 1:
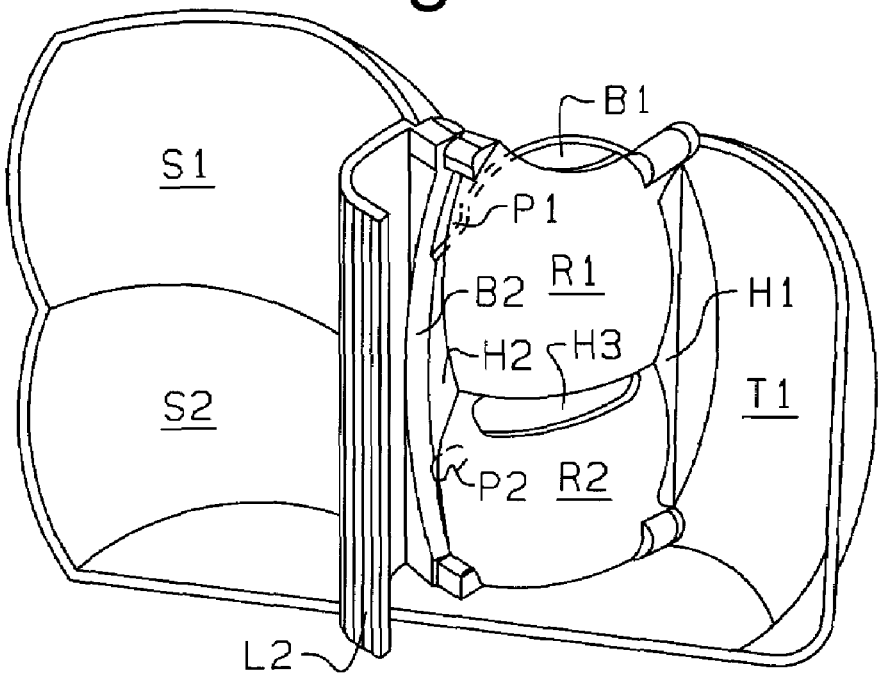
FIG. 1 is a front perspective view of an exemplary embodiment of a vehicle headlight made in accordance with principles of the disclosed subject matter.
Figure 2:
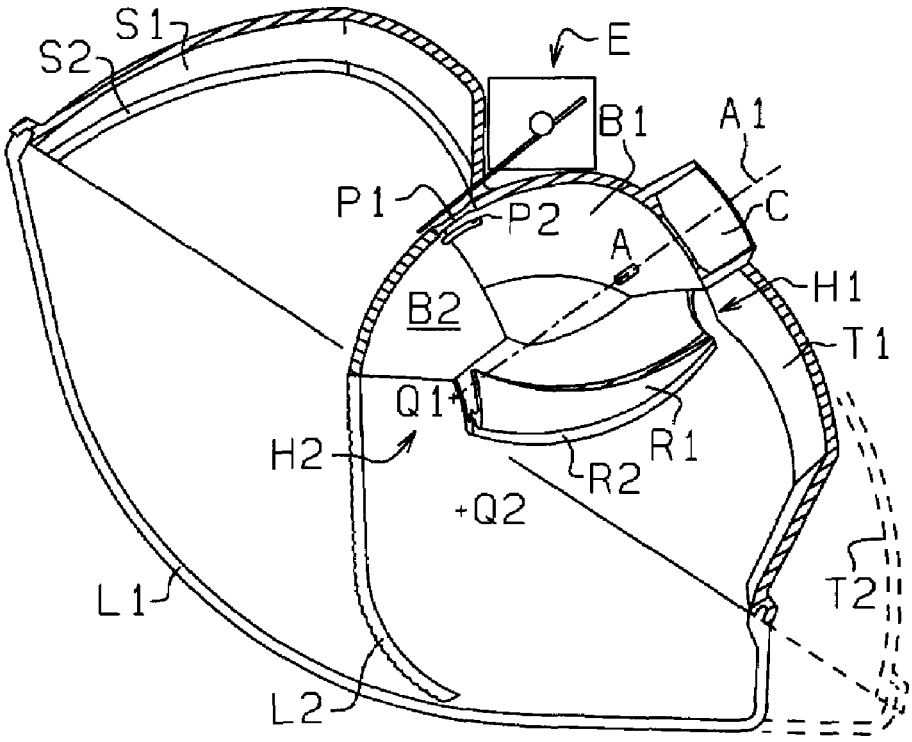
FIG. 2 is a top sectional view of the vehicle headlight of FIG. 1, taken along a horizontal plane.
Figure 3:
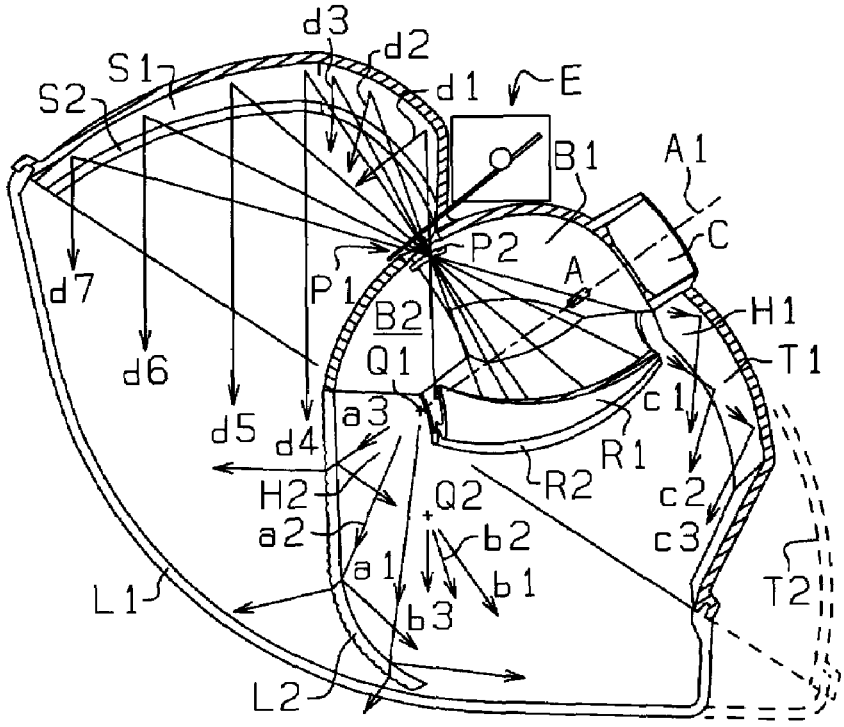
FIG. 3 is a diagram showing optical paths for light that can be projected from the vehicle headlight shown in FIG. 2.

Hereinafter, exemplary embodiments of vehicle headlights made in accordance with principles of the presently disclosed subject matter will be described. FIG. 1 is a perspective view of an exemplary embodiment of a vehicle headlight made in accordance with principles of the disclosed subject matter. FIG. 2 is a sectional view of the vehicle headlight shown in FIG. 1, taken along a horizontal plane. FIG. 3 is a diagram showing the optical paths of light that are projected from the vehicle headlight as shown in FIG. 2.

In the embodiment shown in FIG. 1, directional characteristics with respect to the vehicle headlight shall be expressed in terms of the top, bottom, right, and left in a front view of the same. For the vehicle, directional characteristics shall be expressed in terms of the front, rear, right, and left with reference to the forward direction of the vehicle. Descriptions as to the top, bottom, right, and left on the drawings will be added as appropriate.

The vehicle headlight according to FIG. 1 is a right headlight of a vehicle for exemplary purposes, and is arranged to wrap around from the front towards the right side of the vehicle. In the exemplary embodiment, the first side of the vehicle headlight can be considered to be the right side of the vehicle headlight (as viewed from the rear side of the vehicle headlight, and corresponding to the right side of the vehicle) while the opposite side can be considered to be the left side of the vehicle headlight (as viewed from the rear side of the vehicle headlight, and corresponding to a portion of the headlight that is closer to the center of the vehicle). Of course, the terms first side and opposite side could correlate to the left side and right side of the vehicle headlight (as viewed from the rear side), respectively, when describing a vehicle headlight configured for the left side of a vehicle.

In FIGS. 1 to 3, the letter "A" denotes a light source such as the high intensity portion of a discharge lamp (HID lamp). The letter "C" denotes a socket hole for mounting a bulb (not shown), the bulb having the light source A built in.

In FIGS. 1 to 3, the alphanumeric R1 denotes a first front reflector which can also be considered a first reflector. The first front reflector R1 reflects light that is emitted towards an area in front of the vehicle headlight (towards the near side and out of the paper in FIG. 1, towards the bottom of the drawing in FIGS. 2 and 3, and out of the front of the vehicle) and above the vehicle headlight (towards the top of the drawing in FIG. 1, towards the near side and out of the paper in FIGS. 2 and 3) from the light source A, towards an area in back of the vehicle headlight (towards the far side and into the paper in FIG. 1, towards the top of the drawing in FIGS. 2 and 3, towards an area in the rear of the vehicle). The alphanumeric R2 denotes a second front reflector that can be considered part of a first reflector. The second front reflector R2 reflects light that is emitted towards an area in front of the vehicle headlight (towards the near side and out of the paper in FIG. 1, towards the bottom of the drawing in FIGS. 2 and 3, towards an area in the front of the vehicle) and below the vehicle headlight (towards the bottom of the drawing in FIG. 1, towards the far side and into the paper in FIGS. 2 and 3) from the light source A, towards an area in the back of the vehicle headlight (towards the far side and into the paper in FIG. 1, towards the top of the drawing in FIGS. 2 and 3, and towards an area in the rear of the vehicle).

In FIGS. 1 to 3, the alphanumeric H3 denotes a direct light hole for letting light emitted from the light source A to pass therethrough and be emitted to an area in the front of the vehicle headlight (towards the near side and out of the paper in FIG. 1, towards the bottom of the drawing in FIGS. 2 and 3, and towards an area in the front of the vehicle). The direct light hole H3 can be located on the border between the first front reflector R1 and the second front reflector R2.

In FIGS. 1 to 3, the alphanumeric B1 denotes a first rear reflector that can also be described as a third reflector. The first rear reflector B1 reflects light that is emitted towards the back of the vehicle headlight (towards the far side and into the paper in FIG. 1, towards the top of the drawing in FIGS. 2 and 3, and towards the rear of the vehicle) from the light source A, to the front left of the vehicle headlight (the near left in FIG. 1, the bottom left in FIGS. 2 and 3, and the front and the right side of the vehicle).

In the vehicle headlight as described above, the reflecting surface of the first rear reflector B1 can be configured by combining a plurality of elliptic arcs. To be more specific, the reflecting surface of the first rear reflector B1, in cross section, can be configured to trace an elliptic arc. The light source A (see FIGS. 2 and 3) falls on or near a first focus of the elliptic arc, with a point Q1 (see FIGS. 2 and 3) on or near a second focus of the elliptic arc. In vertical section, the reflecting surface of the first rear reflector B1 traces a parabola-like elliptic arc. More specifically, the light source A is positioned on or near a first focus of the elliptic arc while a second focus of the elliptic arc is approximately 40 mm in front (towards the bottom of the drawings in FIGS. 2 and 3) of the light source A.

In FIGS. 1 to 3, the alphanumeric B2 denotes a second rear reflector which can also be considered a third reflector. The second rear reflector B2 reflects light that is emitted to the left of the vehicle headlight (the left in FIG. 1, the left in FIGS. 2 and 3, the right side of the vehicle) from the light source A, to the front right of the vehicle headlight (the near right in FIG. 1, the bottom right in FIGS. 2 and 3, the front and center of the vehicle).

In the vehicle headlight according to the above-described exemplary embodiment, the reflecting surface of the second rear reflector B2 can be configured by combining a plurality of elliptic arcs. To be more specific, the reflecting surface of the second rear reflector B2, in cross section, can trace an elliptic arc. The light source A (see FIGS. 2 and 3) falls on or near a first focus of the elliptic arc, with a point Q2 (see FIGS. 2 and 3) on or near a second focus of the elliptic arc. In vertical section, the reflecting surface of the second rear reflector B2 traces a parabola-like elliptic arc. More specifically, the light source A is positioned on or near a first focus of the elliptic arc while a second focus of the elliptic arc is approximately 40 mm in front (towards the bottom of the drawing in FIGS. 2 and 3) of the light source A.

In FIGS. 1 to 3, the alphanumeric P1 denotes a hole for letting the light reflected from the first front reflector R1 to pass through. The hole P1 is located on the border between the first rear reflector B1 and the second rear reflector B2. The alphanumeric P2 denotes a hole for letting the light reflected from the second front reflector R2 pass through. The hole P2 is located on the border between the first rear reflector B1 and the second rear reflector B2.

In the above-described vehicle headlight embodiment, the reflecting surface of the first front reflector R1 is configured by combining a plurality of elliptic arcs. In this instance, the light source A falls on or near a first focus of the elliptic reflecting surface, with the hole P1 on or near a second focus of the elliptic reflecting surface. More specifically, the reflecting surface of the first front reflector R1 is made of an ellipsoid of revolution formed by rotating the elliptic arc around the line that connects the first focus and the second focus. It should be appreciated that the disclosed subject matter is not limited thereto, and the reflecting surface of the first front reflector R1 may also be made of a free curved surface similar to an ellipsoid of revolution or other surfaces or combined reflector surfaces.

In the vehicle headlight embodiment described above, the reflecting surface of the second front reflector R2 is formed by combining a plurality of elliptic arcs. In this instance, the light source A falls on or near a first focus of the elliptic reflecting surface, with the hole P2 on or near a second focus of the elliptic reflecting surface. More specifically, the reflecting surface of the second front reflector R2 is composed of an ellipsoid of revolution formed by rotating the elliptic arc around the line that connects the first focus and the second focus. It should be appreciated that the disclosed subject matter is not limited thereto, and the reflecting surface of the second front reflector R2 may also be made of a free curved surface similar to an ellipsoid of revolution, or other surfaces or combinations of surfaces.

In FIGS. 1 to 3, the alphanumeric L2 denotes an inner lens. The inner lens L2 reflects some of the reflection light from the first rear reflector B1 and refracts the rest of the reflection light from the first rear reflector B1. The inner lens L2 is arranged in front (the near side out of the paper in FIG. 1, the bottom of the drawing in FIGS. 2 and 3, the front of the vehicle) of the second rear reflector B2. The alphanumeric H2 denotes a center exit hole. The center exit hole H2 lets the reflection light from the first rear reflector B1 reach the inner lens L2, and lets the reflection light from the second rear reflector B2 pass through. For this purpose, the center exit hole H2 is located between the first and second front reflectors R1, R2 and the inner lens L2.

In FIGS. 1 to 3, the alphanumeric S1 denotes a first side reflector which can be considered a second reflector. The first side reflector S1 reflects the reflection light from the first front reflector R1 that passes through the hole P1, to the front of the vehicle headlight (the near side in FIG. 1, the bottom in FIGS. 2 and 3, the front of the vehicle) and towards the front left of the vehicle headlight (the near left in FIG. 1, the bottom left in FIGS. 2 and 3, the front and the right side of the vehicle). The alphanumeric S2 denotes a second side reflector that can also be considered a second reflector. The second side reflector S2 reflects the reflection light from the second front reflector R2 that passes through the hole P2 towards the front of the vehicle headlight (the near side in FIG. 1, the bottom in FIGS. 2 and 3, the front of the vehicle) and towards the front left of the vehicle headlight (the near left in FIG. 1, the bottom left in FIGS. 2 and 3, the front and the right side of the vehicle).

In FIGS. 1 to 3, the alphanumeric T1 denotes a third side reflector that can be considered a fourth reflector. The third side reflector T1 reflects light that is emitted to the right of the vehicle headlight (the right in FIG. 1, the right in FIGS. 2 and 3, the center of the vehicle) from the light source A, to the front left of the vehicle headlight (the near left in FIG. 1, the bottom left in FIGS. 2 and 3, the front and the right side of the vehicle). The alphanumeric H1 denotes an exit hole, which lets light emitted from the light source A reach the reflector T1. The exit hole H1 is located between the first and second front reflectors R1, R2 and the third side reflector T1. The alphanumeric L1 denotes an outer lens.

In the vehicle headlight embodiment described above, as shown in FIG. 1, the third side reflector T1 protrudes to the right (to the right in FIG. 1, to the center of the vehicle) only slightly. The disclosed subject matter is not limited thereto, however. For example, as shown by broken lines in FIGS. 2 and 3, the third side reflector T1 may be replaced with a third side reflector T2 which protrudes to a greater extent to the right of the headlight (the right in FIG. 1, the right in FIGS. 2 and 3, the center of the vehicle). In this modified embodiment, the gap (exit hole H1) to be formed between the first and second front reflectors R1, R2 and the third side reflector T2 has a width dimension (the lateral dimension in FIGS. 2 and 3) that is greater than the non-modified embodiment.

Consequently, the vehicle headlight of this modified embodiment provides reflection light of higher intensity from the third side reflector T2 as compared to the non-modified vehicle headlight embodiment.

If the entire vehicle headlight requires a reduction in width dimension, on the other hand, the third side reflector T1 (T2) and the exit hole H1 may be omitted depending on the specifications for the light distribution characteristics.

In FIGS. 1 to 3, the alphanumeric E denotes a distribution pattern switching unit. The distribution pattern switching unit E switches the distribution pattern of the light to be projected from the first side reflector S1 between a low beam distribution pattern and a high beam distribution pattern. The distribution pattern switching unit E can be arranged between the first front reflector R1 and the first side reflector S1.

As shown in FIG. 2, the vehicle headlight embodiment is designed in a slanted shape and arranged to be placed in a vehicle so that the normal to the outer lens L1 at the left end (the left end in FIG. 2, the end at the right side of the vehicle) forms an angle of approximately 70° with respect to the front-to-back direction of the vehicle (the vertical direction in FIG. 2, the direction of the main optical axis of the entire vehicle headlight). It should be appreciated that the vehicle headlight may have a lateral dimension (the lateral dimension in FIG. 2) of approximately 200 mm, for example.

As shown in FIG. 2, the inner lens L2 extends from a position near the end of the second rear reflector B2 to the front (the bottom in FIG. 2) with the extremity of the inner lens L2 bending at its end portion (the bottom end in FIG. 2). It should be appreciated that these members may be formed separately and combined afterward, or may be formed as a single member. For example, in the case of the vehicle headlight embodiment shown in FIG. 1, the inner lens L2 and the second rear reflector B2 can be integrally made of a single member, and the first rear reflector B1, the first and second side reflectors S1 and S2, and the third side reflector T1 can also be integrally made of a single member. In this case, these members may be integrally molded from a transparent resin material, and a bright treatment may be applied to the reflector areas to simultaneously form both the lens portion and the reflector portions.

As shown in FIG. 2, the light source A is located so that the main optical axis A1 of the light source A forms an angle of approximately 30° to 60° with respect to the front-to-back direction of the vehicle (the vertical direction in FIG. 2, the direction of the main optical axis of the entire vehicle headlight), with the extremity of the light source A toward the front and the right side (the bottom left in FIG. 2) of the vehicle.

As shown in FIG. 2, part of the first front reflector R1 is located closer to the front and the center of the vehicle (the bottom right in FIG. 2) than the light source A is so that a tangential line of part of the horizontal profile curve (cross-sectional curve) of its elliptic reflecting surface is substantially parallel with the main optical axis A1 of the light source A. Similarly, though not shown in detail, part of the second front reflector R2 is located closer to the front and the center of the vehicle (the bottom right in FIG. 2) than the light source A is so that a tangential line of part of the horizontal profile curve (cross-sectional curve) of its elliptic reflecting surface is substantially parallel with the main optical axis A1 of the light source A.

As shown in FIG. 2, the first side reflector S1 is arranged closer to the rear and the right side of the vehicle (the top left in FIG. 2) than the light source A is. The reflecting surface of the first side reflector S1 is configured so that an average distance from the second focus of the elliptic reflecting surface of the first front reflector R1 to the reflecting surface of the first side reflector S1 is approximately 40 mm or more.

As shown in FIG. 2, the second side reflector S2 is arranged closer to the rear and the right side of the vehicle (the top left in FIG. 2) than the light source A is. The reflecting surface of the second side reflector S2 is configured so that an average distance from the second focus of the elliptic reflecting surface of the second front reflector R2 to the reflecting surface of the second side reflector S2 is approximately 40 mm or more.

As shown in FIG. 3, the light emitted from the light source A to the front (the bottom in FIG. 3) and the top (the near side in FIG. 3) is reflected by the elliptic reflecting surface of the first front reflector R1 so that it is collected at the second focus of the elliptic reflecting surface. The light is then let through the hole P1 to be diffused, and is reflected by the reflecting surface of the first side reflector S1. The light d1, d2, and d3 reflected by the right area of the reflecting surface of the first side reflector S1 (the right area in FIG. 3, the area closer to the center of the vehicle) is collected. The light is then projected to the front and the right side of the vehicle (the bottom left in FIG. 3) to be diffused as diffusion light. In the meantime, the light d4, d5, d6, and d7 reflected by the left area of the reflecting surface of the first side reflector S1 (the left area in FIG. 3, the area closer to the right side of the vehicle) is projected to the front of the vehicle (the bottom in FIG. 3) as a spot light which is substantially parallel with the front-to-back direction of the vehicle (the vertical direction in FIG. 3). More specifically, in the vehicle headlight embodiment of FIG. 3, approximately one-third of the light reflected from the reflecting surface of the first side reflector S1 is projected to the front and the right side of the vehicle (the bottom left in FIG. 3) as diffusion light. Approximately two-thirds of the light is projected to the front of the vehicle (the bottom in FIG. 3) as a spot light.

It should be noted that the vehicle headlight embodiment of FIGS. 1-3 is configured so that the reflecting surface of the first side reflector S1 that is configured for collecting the light from the first front reflector R1 and reflecting the same to the front of the vehicle (the bottom in FIG. 3) is an average of approximately 40 mm or more away from the second focus of the elliptic reflecting surface of the first front reflector R1.

The vehicle headlight is arranged to wrap around from the front to the right side of the vehicle in this example. Because of this configuration, the reflecting surfaces for collecting light and reflecting the same to the front of the vehicle are located relatively close to the light source, similar to the conventional art vehicle headlights shown in FIG. 15 of Japanese Patent Application Laid-Open No. 2001-6409 and FIG. 7 of Japanese Patent Application Laid-Open No. Hei 6-203612. However, in the vehicle headlight of the present exemplary embodiment, the reflecting surface of the first side reflector S1 can be made wider than in the conventional cases. As a result, it is possible to project highly-collected light to the front of the vehicle (the bottom in FIG. 3) to illuminate the front of the vehicle (the bottom in FIG. 3) with greater brightness as compared to such vehicle headlights as shown in FIG. 15 of Japanese Patent Application Laid-Open No. 2001-6409 and FIG. 7 of Japanese Patent Application Laid-Open No. Hei 6-203612. The use of the first side reflector S1 having a wide area can increase the light-projecting area (bright area, or the left area of the reflecting surface of the first side reflector S1 in particular) when the vehicle headlight is viewed from the front of the vehicle (the bottom in FIG. 3).

Although not shown in detail, in the vehicle headlight embodiment of FIGS. 1-3, the light emitted from the light source A to the front (the bottom in FIG. 3) and the bottom (the far side into the paper in FIG. 3) is similarly reflected by the elliptic reflecting surface of the second front reflector R2 so that the light is collected at the second focus of the elliptic reflecting surface. The light is then let through the hole P2 (see FIG. 1) to be diffused, and is reflected by the reflecting surface of the second side reflector S2. The light reflected by the right area of the reflecting surface of the second side reflector S2 (the right area of FIG. 3, the area closer to the center of the vehicle) is collected. The light is then projected to the front and the right side of the vehicle (the bottom left in FIG. 3) to be diffused as diffusion light. In the meantime, the light reflected by the left area of the reflecting surface of the second side reflector S2 (the left area in FIG. 3, the area closer to the right side of the vehicle) is projected to the front of the vehicle (the bottom in FIG. 3) as a spot light which is substantially parallel with the front-to-back direction of the vehicle (the vertical direction in FIG. 3). More specifically, approximately one-third of the light reflected from the reflecting surface of the second side reflector S2 is projected to the front and the right side of the vehicle (the bottom left in FIG. 3) as diffusion light. Approximately two-thirds of the light is projected to the front of the vehicle (the bottom in FIG. 3) as a spot light.

It should be noted that the vehicle headlight embodiment of FIGS. 1-3 is configured so that the reflecting surface of the second side reflector S2 that is configured to collect the light from the second front reflector R2 and reflect the same to the front of the vehicle (the bottom in FIG. 3) is an average of approximately 40 mm or more away from the second focus of the elliptic reflecting surface of the second front reflector R2.

As mentioned previously, the vehicle headlight can be arranged to wrap around from the front to the right side of the vehicle. Because of this configuration, the reflecting surfaces for collecting light and reflecting the same to the front of the vehicle are located relatively close to the light source, like those vehicle headlights shown in FIG. 15 of Japanese Patent Application Laid-Open No. 2001-6409 and FIG. 7 of Japanese Patent Application Laid-Open No. Hei 6-203612. In the vehicle headlight of the embodiment shown in FIGS. 1-3, the reflecting surface of the second side reflector S2 can be made wider than those in the conventional cases.

Figure 7:
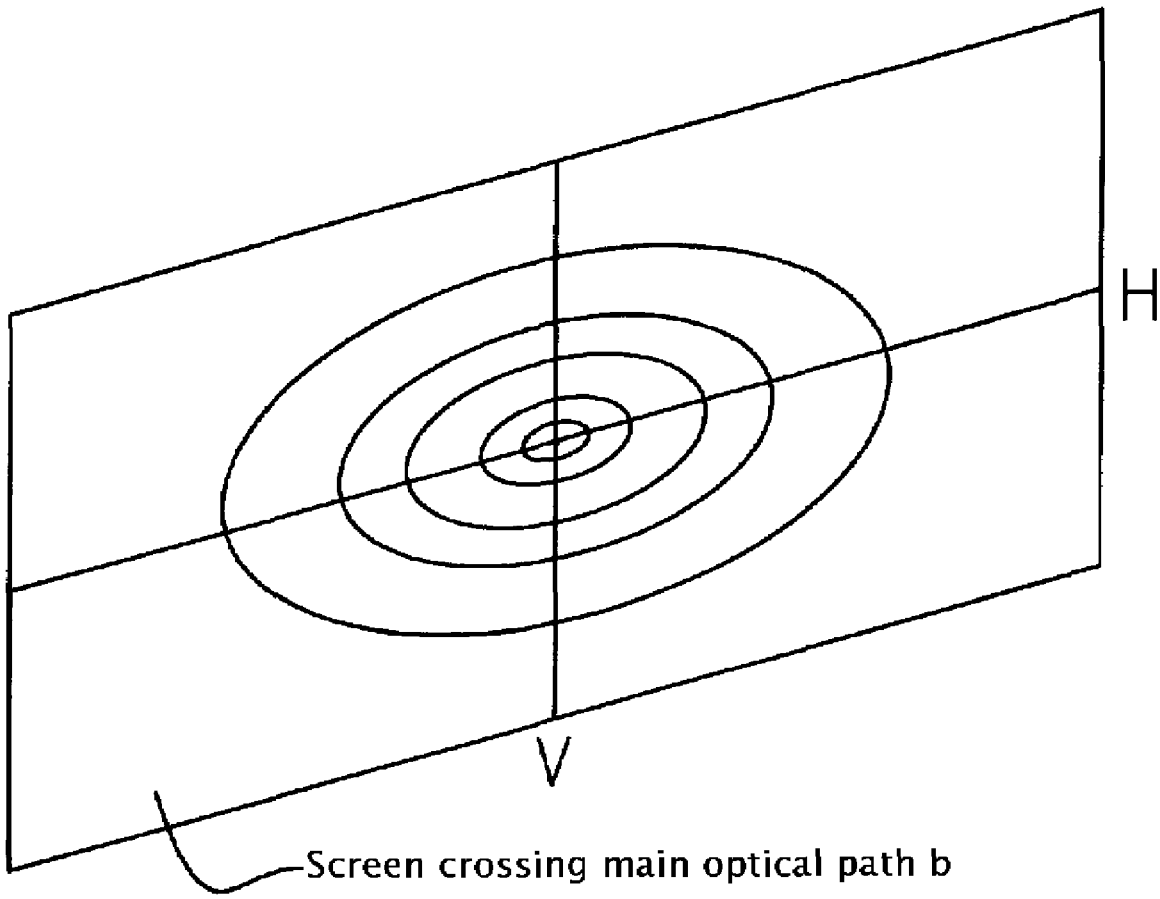
FIG. 7 is a conceptual diagram showing a reflection image formed by the reflector of FIG. 6.

As a result, it is possible to project highly-collected light to the front of the vehicle (the bottom in FIG. 3) to illuminate the front of the vehicle (the bottom in FIG. 3) with greater brightness as compared to the vehicle headlights shown in FIG. 15 of Japanese Patent Application Laid-Open No. 2001-6409 and FIG. 7 of Japanese Patent Application Laid-Open No. Hei 6-203612. The use of the second side reflector S2 which have a wide area can increase the light-projecting area (bright area, or the left area of the reflecting surface of the second side reflector S2 in particular) when the vehicle headlight is viewed from the front of the vehicle (the bottom in FIG. 3).

As shown in FIGS. 2 and 3, the light source A can be arranged so that the main optical axis A1 of the light source A forms an angle of approximately 30° to 60° to the front-to-back direction of the vehicle (the vertical direction in FIGS. 2 and 3, the direction of the main optical axis of the entire vehicle headlight). In other words, the side surface (cylindrical surface) of the light source A can be opposed to the first and second front reflectors R1 and R2. The light from the light source A impinges on the first and second front reflectors R1 and R2, and the light reflected from these surfaces is collected in accordance with the shapes of the reflectors to create horizontally-long pseudo light sources in the vicinities of the holes P1 and P2 (see FIG. 1). The light beams from these pseudo light sources are reflected by the left areas (the left areas in FIGS. 2 and 3) of the reflecting surfaces of the first and second side reflectors S1 and S2 efficiently with an angle of incidence and an angle of reflection of approximately 20°, and thus projected to the front of the vehicle (the bottom in FIGS. 2 and 3) as a spot light.

As shown in FIGS. 2 and 3, the light emitted from the light source A to the right of the vehicle headlight (the right in FIGS. 2 and 3, the center of the vehicle) is allowed to pass through the exit hole h1. This light is incident on the reflecting surface of the third side reflector T1, and is reflected and projected as diffusion light c1, c2, and c3 in the direction of projection of the vehicle headlight, or in particular, to the front left of the vehicle headlight (the bottom left in FIGS. 2 and 3, the front and the right side of the vehicle).

That is, as shown in FIG. 3, the light that is emitted from the light source A to the right of the vehicle headlight (the right in FIG. 3, the center of the vehicle) and which passes through the exit hole H1 is projected to the front left of the vehicle headlight (the bottom left in FIG. 3, the front and right side of the vehicle) after only a single reflection from the third side reflector T1 which is located closer to the center of the vehicle than the first and second front reflectors R1 and R2.

Consequently, as compared to the cases where all the light emitted from the light source A is reflected twice or more before being projected in the direction of projection of the vehicle headlight, the vehicle headlight embodiment of FIGS. 1-3 can reduce reflection-based loss in light intensity. This makes it possible to project light of higher intensity in the direction of projection of the vehicle headlight (the bottom left in FIG. 3).

As shown in FIG. 3, the light emitted from the light source A to the back of the vehicle headlight (the top in FIG. 3) is reflected to the front left of the vehicle headlight (the bottom left in FIG. 3) by the reflecting surface of the first rear reflector B1. To be more specific, the reflection light from the reflecting surface of the first rear reflector B1 is collected at the focus of the first rear reflector B1 in the lateral direction of the vehicle headlight (the lateral direction in FIG. 3), and then passes the point Q1. Subsequently, the light is incident on the inner lens L2 as diffusion light a1, a2, and a3. Most of the incident light a1, a2, and a3 that impinges on the inner lens L2, is refracted by the inner lens L2, and is projected to the left of the vehicle headlight (the left in FIG. 3, the right side of the vehicle) as highly-diffused light. Specifically, the incident light a3 is refracted by the inner lens L2, and is projected to the back left of the vehicle headlight (the top left in FIG. 3, and the rear and the right side of the vehicle) with a large angle of approximately 100° to the longitudinal axis of the vehicle (vertically downward in FIG. 3). In the meantime, the incident light a1 and a2 is reflected by the incident surface (the right surface in FIG. 3) and/or the exit surface (the left surface in FIG. 3) of the inner lens L2, and projected to the front right of the vehicle headlight (the bottom right in FIG. 3, the front and the center of the vehicle) as diffusion light.

Although not shown in the diagrams, the vehicle headlight embodiment of FIGS. 1-3 can be configured so that the reflection light from the reflecting surface of the first rear reflector B1 is collected in the vertical direction of the vehicle headlight (the near-to-far direction into and out of the paper in FIG. 3). More specifically, the vehicle headlight may be configured so that the reflection light from the reflecting surface of the first rear reflector B1 is vertically collected at a point approximately 40 mm in front (below, in FIG. 3) of the light source A while being laterally diffused into a horizontal band-like shape.

As shown in FIG. 3, the light emitted from the light source A to the left of the vehicle headlight (the left in FIG. 3) is reflected to the front right of the vehicle headlight (the bottom right in FIG. 3, the front and the center of the vehicle) by the reflecting surface of the second rear reflector B2. To be more specific, the reflection light from the reflecting surface of the second rear reflector B2 is collected at the focus of the second rear reflector B2 in the lateral direction of the vehicle headlight (the lateral direction in FIG. 3), and then passes the point Q2. Subsequently, the light is projected to the front right of the vehicle headlight (the bottom right in FIG. 3, the front and the center of the vehicle) as diffusion light b1, b2, and b3 without impinging on the inner lens L2.

Although not shown in the drawing, the vehicle headlight embodiment of FIGS. 1-3 can be configured so that the reflection light from the reflecting surface of the second rear reflector B2 is collected in the vertical direction of the vehicle headlight (the near-to-far direction in FIG. 3). More specifically, the vehicle headlight may be configured so that the reflection light from the reflecting surface of the second rear reflector B2 is vertically collected at a point approximately 40 mm in front (below, in FIG. 3) of the light source A while being laterally diffused into a horizontal band-like shape.

As described above and as shown in FIGS. 2 and 3, the first rear reflector B1, that can be configured to consist of or comprise an elliptic reflecting surface, is arranged between the first and second front reflectors R1, R2 and the first and second side reflectors S1, S2 so that the light source A falls on or near the first focus of the elliptic reflecting surface of the first rear reflector B1.

Moreover, as shown in FIG. 3, the light from the first rear reflector B1 can be collected at the second focus Q1 of the elliptic reflecting surface. Subsequently, the light is diffused out and then passes through the inner lens L2. Put another way, in the vehicle headlight embodiment of FIGS. 1-3, the light from the light source A is collected before passing through the inner lens L2 as shown in FIG. 3.

When compared to the case where the light from the light source A is not collected before passing through the inner lens L2, the vehicle headlight embodiment of FIGS. 1-3 can increase the angle of diffusion with which the light is projected in the direction of projection of the vehicle headlight (the left in FIG. 3, the right side of the vehicle).

As shown in FIGS. 1-3, the vehicle headlight embodiment is provided with the inner lens L2 for diffusing light from the light source A. This makes it possible to diffuse the light that is to be projected in the direction of projection of the vehicle headlight (the left in FIG. 3), and to project bright light to the right side of the vehicle (the left in FIG. 3).

The inner lens L2 is also arranged so that the refracted light that passes through the inner lens L2 is diffused by the inner lens L2 and is projected in the direction of projection of the vehicle headlight (the left in FIG. 3), while the light reflected by the inner lens L2 is diffused and is projected in the direction of projection of the vehicle headlight (the bottom right in FIG. 3).

As described above and as shown in FIG. 3, the reflection light that is reflected by the incident surface (the right surface in FIG. 3) and/or the exit surface (the left surface in FIG. 3) of the inner lens L2 and the refracted light that passes through the inner lens L2 to emanate from the exit surface of the inner lens (the left surface in FIG. 3) are both projected in the direction of projection of the vehicle headlight (the left and the bottom right in FIG. 3).

When compared to the case where only the refracted light that passes through the inner lens L2 is projected in the direction of projection of the vehicle headlight (the left in FIG. 3), the vehicle headlight according to the above-described embodiment can thus increase the angle of diffusion with which the light is projected in the direction of projection of the vehicle headlight (the left and the bottom right in FIG. 3), and improve the use efficiency of light as well.

As shown in FIGS. 1 and 2, part of the light emitted from the light source A to the front and the bottom of the vehicle headlight (the near side and the bottom in FIG. 1, the bottom and the far side in FIG. 2) passes through the direct light hole H3 and is projected to the front of the vehicle headlight (the front of the vehicle) without any reflection. In this instance, the vehicle headlight is configured so that the upper rim of the direct light hole H3 comes to almost the same height as that of the light source A. This prevents the light projected through the direct light hole H3 from creating upward glare which possibly dazzles oncoming drivers.

As shown in FIGS. 1 to 3, the direct light that is emitted from the light source A to the front right of the vehicle headlight (the near left in FIG. 1, the bottom left in FIGS. 2 and 3) through the center exit hole H2 passes through the inner lens L2 before being projected to the front left of the vehicle headlight (the front and the right side of the vehicle). In this instance, a lens cut can be formed in the inner lens L2 in order to prevent the direct light that has passed through the inner lens L2 from creating glare which possibly dazzles oncoming drivers. That is, the lens cut in the inner lens L2 can be formed so that the light that passes through the inner lens L2 is projected upward with a relatively low intensity by diffusing the light.

Figure 4:
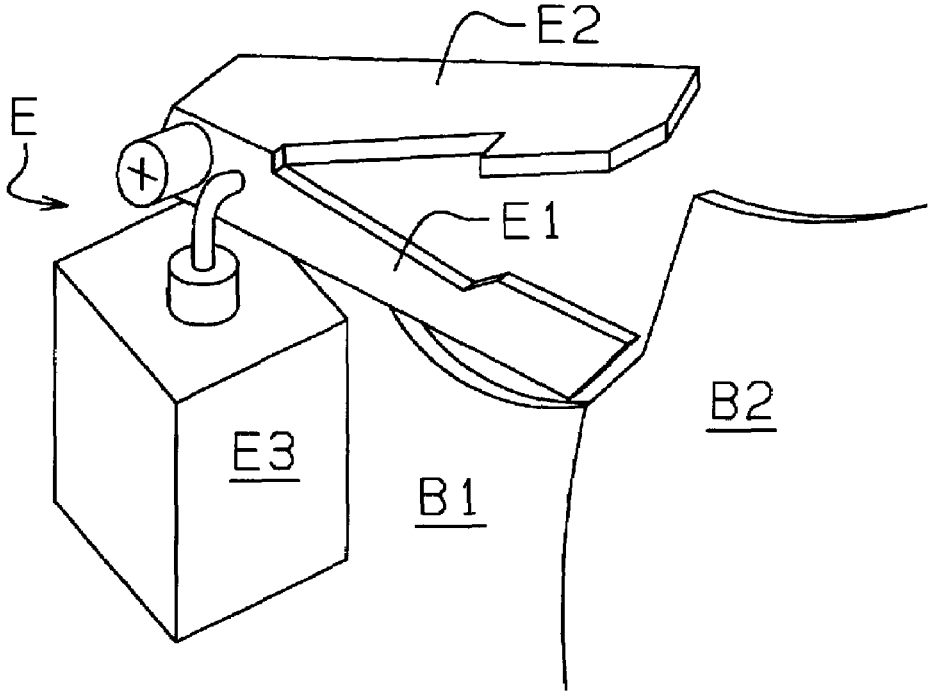
FIG. 4 is a perspective view of the distribution pattern switching unit E as shown in FIGS. 2 and 3.

FIG. 4 is a perspective view of the distribution pattern switching unit E shown in FIGS. 2 and 3. In FIG. 4, the alphanumeric E1 denotes a shield plate for creating a low beam distribution pattern, the alphanumeric E2 denotes a high beam reflection plate for creating a high beam distribution pattern, and the alphanumeric E3 denotes a solenoid for driving the shield plate E1 and the high beam reflection plate E2. While the shield plate E1 and the high beam reflection plate E2 as shown in the vehicle headlight embodiment of FIGS. 1-3 are made integrally of a single member, the disclosed subject matter is not limited thereto. For example, the shield plate E1 and the high beam reflection plate E2 may be made of separate members that can also be controlled separately.

Figure 5A:
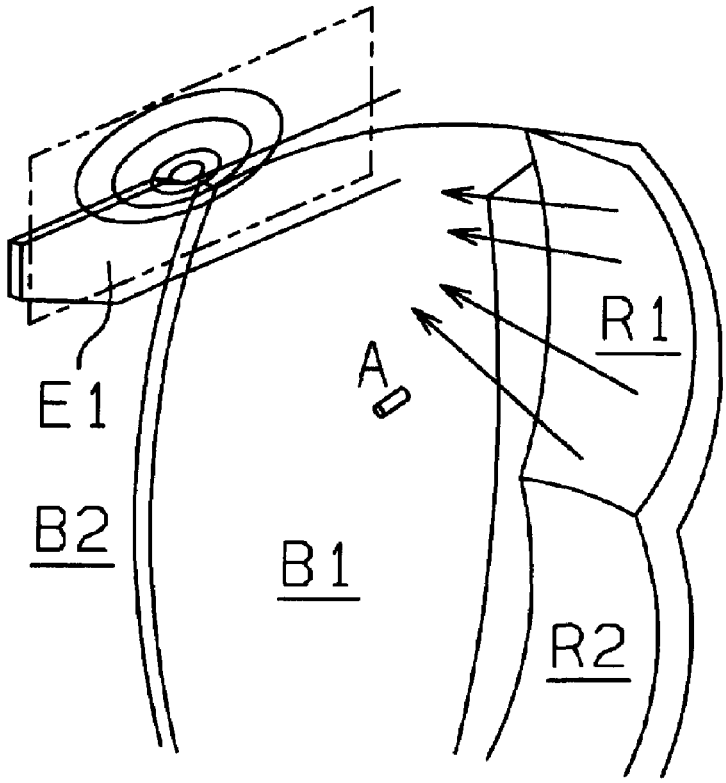
FIGS. 5A and 5B are diagrams showing how the distribution pattern of light that is to be projected from a reflector can be switched between a low beam distribution pattern and a high beam distribution pattern.
Figure 5B:
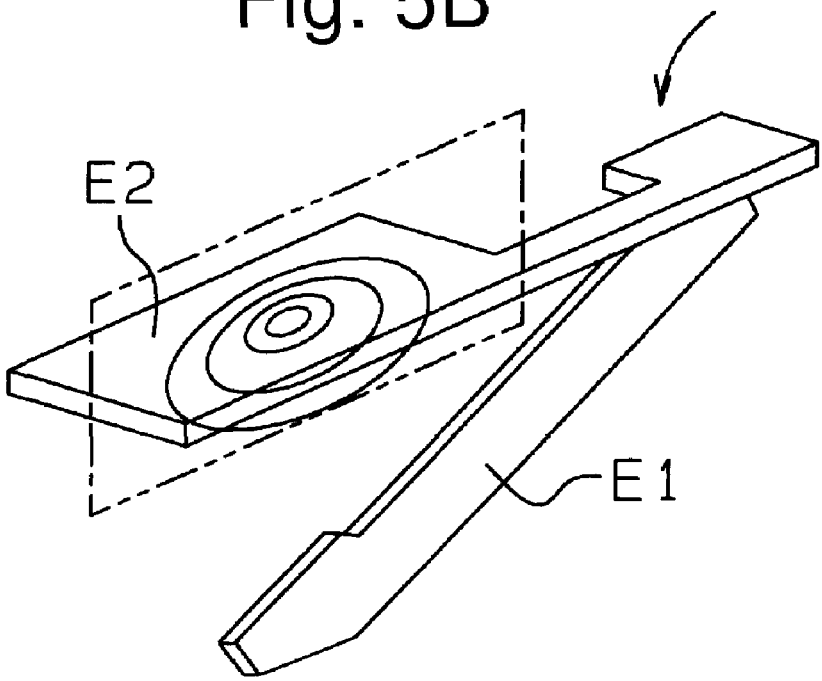

FIGS. 5A and 5B are diagrams showing how the distribution pattern of light projected from the first side reflector S1 is switched between the low beam distribution pattern and the high beam distribution pattern. Specifically, FIG. 5A shows the state where the low beam distribution pattern is created by the shield plate E1. FIG. 5B shows the state where the high beam distribution pattern is created by the high beam reflection plate E2. In FIGS. 5A and 5B, the concentric ellipses boxed in the double-dashed lines indicate pseudo light source images of the light source A formed by the first front reflector R1 in the vicinities of the shield plate E1 and the high beam reflection plate E2.

As shown in FIG. 3, the reflection light from the first and second rear reflectors B1 and B2 and the third side reflector T1 makes diffusion light, and the reflection light from the first and second side reflectors S1 and S2 makes a spot light. In addition to this, the light source A uses the high intensity portion of, for example, a discharge lamp (HID) which provides higher output to the upper half area and lower output to the lower half area. Furthermore, the direct light hole H3 can be formed by cutting off some of the second front reflector R2. Consequently, the reflection light from the second side reflector S2 becomes weaker than the reflection light from the first side reflector S1, falling to around 60% the reflection light from the first side reflector S1. For this reason, the distribution pattern switching unit E may not be formed on the optical path from the light source A to the second side reflector S2 but only on the optical path from the light source A to the first side reflector S1.

As shown in FIG. 5A, when the vehicle headlight of FIGS. 1-3 is configured to create the low beam distribution pattern, the shield plate E1 is put into the optical path from the light source A to the first side reflector S1. That is, the shield plate E1 is situated on the pseudo light source image of the light source A (the concentric ellipses boxed in the double-dashed line in FIG. 5A). In this instance, the shield plate E1 is arranged so that the spot area (the high intensity area, the brightest area) of the reflection light from the first front reflector R1 passes over the shield plate E1 (above, in FIG. 5A) without being shielded by the shield plate E1. When creating the high beam distribution pattern, as shown in FIG. 5B, the high beam reflection plate E3 is rotated by the solenoid E3 in the direction of the arrow in FIG. 5B. As a result, the high beam reflection plate E2 is put into the optical path extending from the light source A to the first side reflector S1. That is, the high beam reflection plate E2 is situated on the pseudo light source image of the light source A (the concentric ellipses boxed in the double-dashed line in FIG. 5B).

When creating the high beam distribution pattern, as shown in FIG. 5B, part of the light from the light source A is reflected by the underside of the high beam reflection plate E2 (the bottom side in FIG. 5B). More specifically, when creating the high beam distribution pattern, the spot area (the high intensity area, the brightest area) of the pseudo light source image of the light source A (the concentric ellipses boxed in the double-dashed line in FIG. 5B) is reflected and shifted somewhat downward by the underside of the high beam reflection plate E2 (the bottom side in FIG. 5B). As a result, the spot area lying above this position spreads out downward as if vertically inverted. When this pseudo light source image (the concentric ellipses boxed in the double-dashed line in FIG. 5B) is reflected by the first side reflector S1 and is projected to the front of the vehicle, the high beam distribution pattern is formed such that it spreads out largely upward.

Conventional low beam distribution patterns can include more than a sufficient amount of downward diffusion light. In view of this, the vehicle headlight embodiment of FIGS. 1-3 can be configured so that part of the downward diffusion light to be projected when creating the low beam distribution pattern is reflected by the high beam reflection plate E2 and is used as upward diffusion light when creating the high beam distribution pattern.

Furthermore, as shown in FIGS. 5A and 5B, the shield plate E1 and the high beam reflection plate E2 can be located at a height near the upper edge of the first front reflector R1, so that the reflection light from the first front reflector R1 impinges on the under side of the high beam reflection plate E2 (the bottom side in FIG. 5B) with high efficiency.

Incidentally, another reflector (not shown) may also be provided in order to reflect the direct light from the light source A, leaking from above the upper edge of the first front reflector R1, and to project it as diffusion light in the direction of projection of the vehicle headlight (the bottom or the left in FIG. 3).

Yet another reflector (not shown) may also be provided to reflect direct light from the light source A, leaking from below the lower edge of the second front reflector R2, and project it as diffusion light in the direction of projection of the vehicle headlight (the bottom or the left in FIG. 3).

In the vehicle headlight of the exemplary embodiment of FIGS. 1-3, the elliptic reflecting surface of the first front reflector R1 and the reflecting surface of the first side reflector S1 are configured to provide the maximum output during low beam illumination, and not to provide the maximum output during high beam illumination. As mentioned above, the shield plate E1 is arranged so that the spot area (the high intensity area, the brightest area) of the reflection light from the first front reflector R1 can pass over the shield plate E1 (above, in FIG. 5A) without being shielded by the shield plate E1.

As shown in FIGS. 4 to 5B, the distribution pattern switching unit E has the high beam reflection plate E2 which is intended to reflect part of the light from the first front reflector R1 to be projected to the lower half of the low beam distribution pattern (the upper halves of the concentric ellipses boxed in the double-dashed line in FIG. 5A) during low beam illumination.

As shown in FIG. 5B, that part of the light reflected from the first front reflector R1 that is to be projected to the lower half of the low beam distribution pattern (the upper halves of the concentric ellipses boxed in the double-dashed line in FIG. 5A) during low beam illumination is reflected by the underside (the bottom side in FIG. 5B) of the high beam reflection plate E2 of the distribution pattern switching unit E, and is projected from the first side reflector S1 to above a horizontal level during high beam illumination.

This configuration has been implemented in view of the fact that the use of the low beam is typically higher in frequency than that of the high beam. In the vehicle headlight of FIGS. 1-3, the elliptic reflecting surface of the first front reflector R1 and the reflecting surface of the first side reflector S1 are configured to provide the maximum output during low beam illumination. Moreover, part of the light to be projected from the first side reflector S1 to below the horizontal level during low beam illumination is reflected by the underside (the bottom side in FIG. 5B) of the high beam reflection plate E2, and is projected from the first side reflector S1 to above the horizontal level during high beam illumination.

Consequently, it is possible to project a low beam and a high beam in a more reasonable and efficient fashion than in a light configuration in which a maximum output is obtained during high beam illumination (which is low in usage frequency).

While the vehicle headlight of the exemplary embodiment shown in FIGS. 1-3 has no automatic leveling system (such as described in Japanese Patent Application Laid-Open No. Hei 10-244871), the disclosed subject matter is not limited thereto. An automatic leveling system may be provided so that it is possible in cooperation with this automatic leveling system to adjust the entire image of the high beam distribution pattern in different ways, including in an up and down direction.

Figure 6:
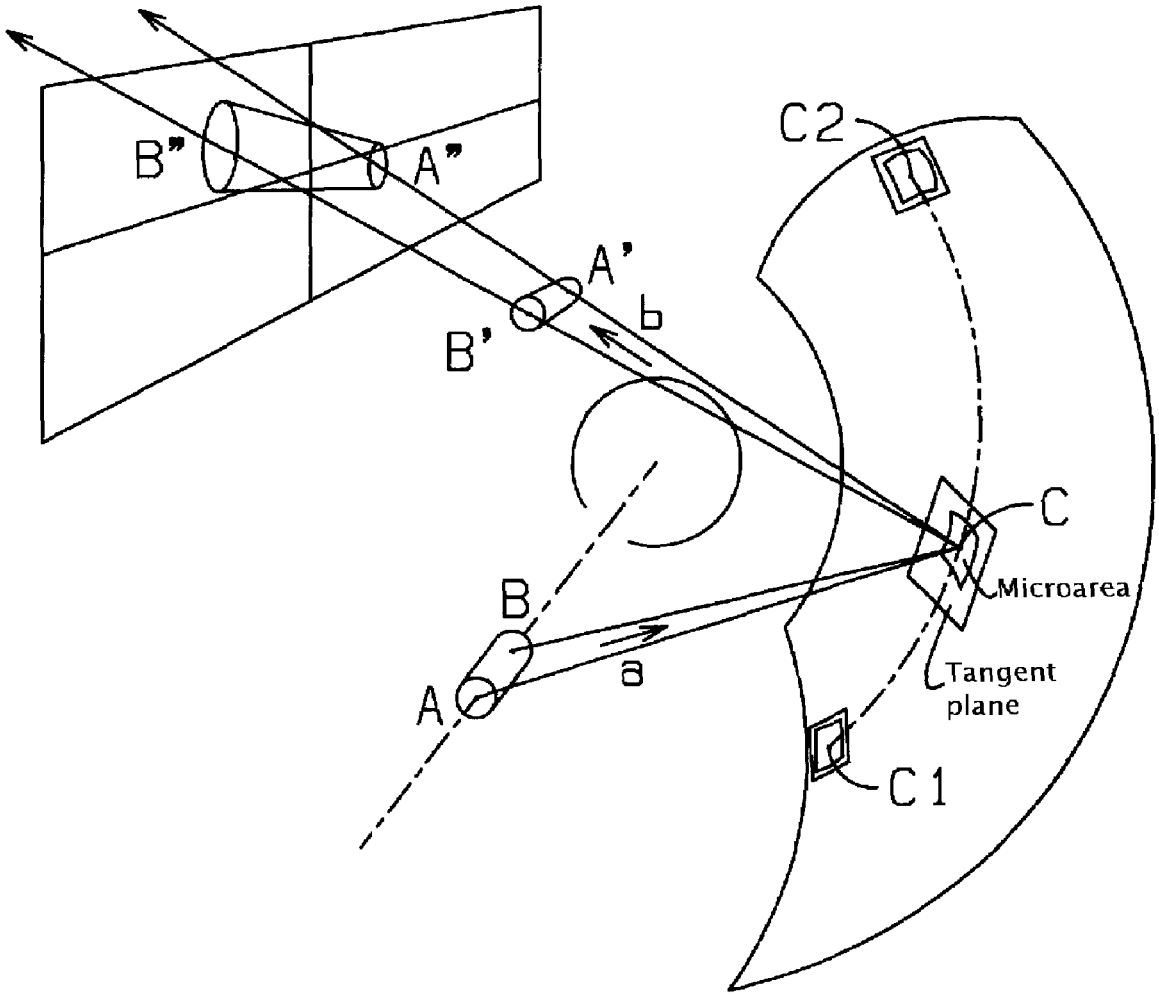
FIG. 6 is a conceptual diagram showing production of a reflection image formed by a reflector in accordance with principles of the disclosed subject matter.

FIGS. 6 to 10 are conceptual diagrams for explaining reflection light images formed by a reflector. In FIG. 6, the reference symbol AB denotes a light source. The reference symbols C, C1, and C2 denote points on the reflector, and the reference letter "a" denotes the optical path of direct light from the light source AB to the reflector. The reference letter "C" denotes the barycentric point on the reflecting surface of the reflector. The reference symbol A'B' denotes a pseudo light source image of the light source AB which is formed by the reflector, and the reference letter "b" denotes the main optical path of reflection light from the reflector. Furthermore, the reference symbol A"B" denotes a reflection image of the light source AB which is formed on a virtual screen that crosses the main optical path b of the reflection light from the reflector.

FIG. 7 is a diagram showing an entire image of all real images formed and superposed on the virtual screen. The reflection image formed on the virtual screen is cloud-like on the whole, with the vicinity of the center (the intersection of the horizontal line H and the vertical line V) being extremely bright.

Figure 8:
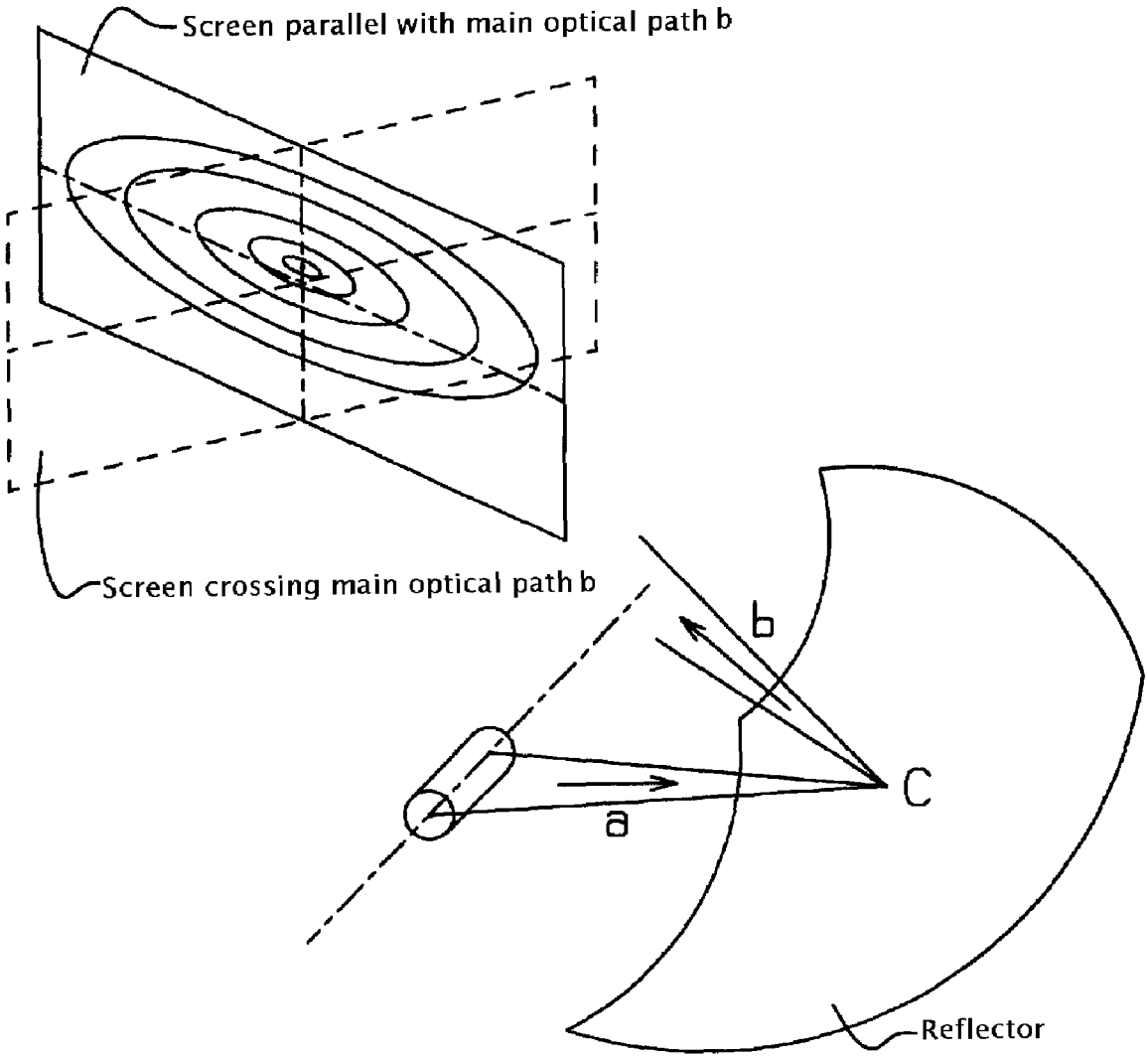
FIG. 8 is a conceptual diagram showing production of a reflection image formed by a reflector in accordance with principles of the disclosed subject matter.

FIG. 8 is a diagram showing a semitransparent virtual screen that lies in parallel with the main optical path b of the reflection light from the reflector. As shown in FIG. 8, a reflection image having the same intensity distribution as that of the reflection image shown in FIG. 7 can be observed even on the transparent virtual screen that is parallel with the main optical path b of the reflection light from the reflector.

Figure 9:
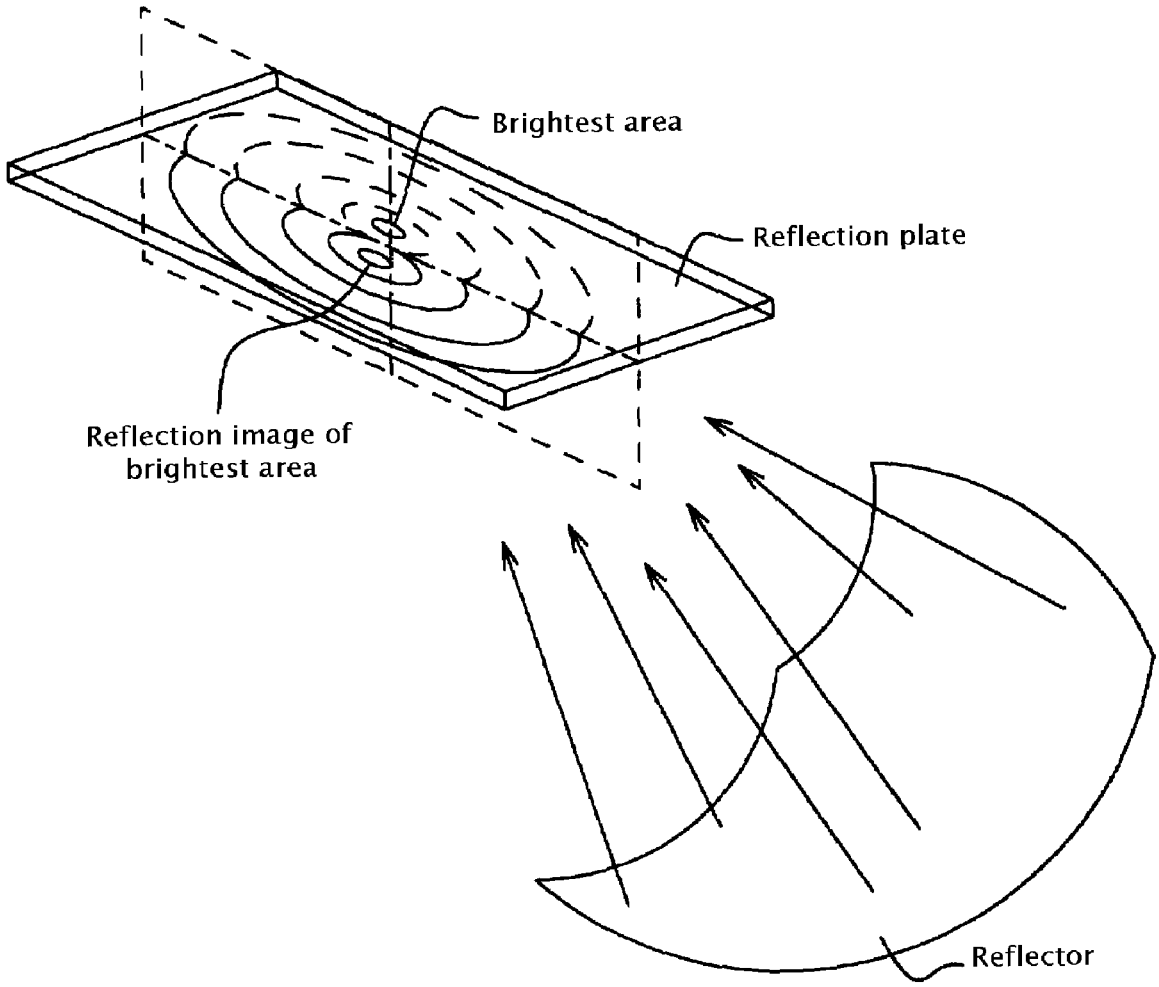
FIG. 9 is a conceptual diagram showing a reflection image formed by the reflector of FIG. 8.

FIG. 9 is a diagram showing a state where a reflection plate is put onto the reflection image shown in FIG. 8 from above. In the example shown in FIG. 9, the brightest area (the spot area, the high intensity area) of the reflection light from the reflector falls within the reflection plate, and the reflection image of the brightest area (the spot area, the high intensity area) is formed on the underside (the bottom side in FIG. 9) of the reflection plate.

Figure 10:
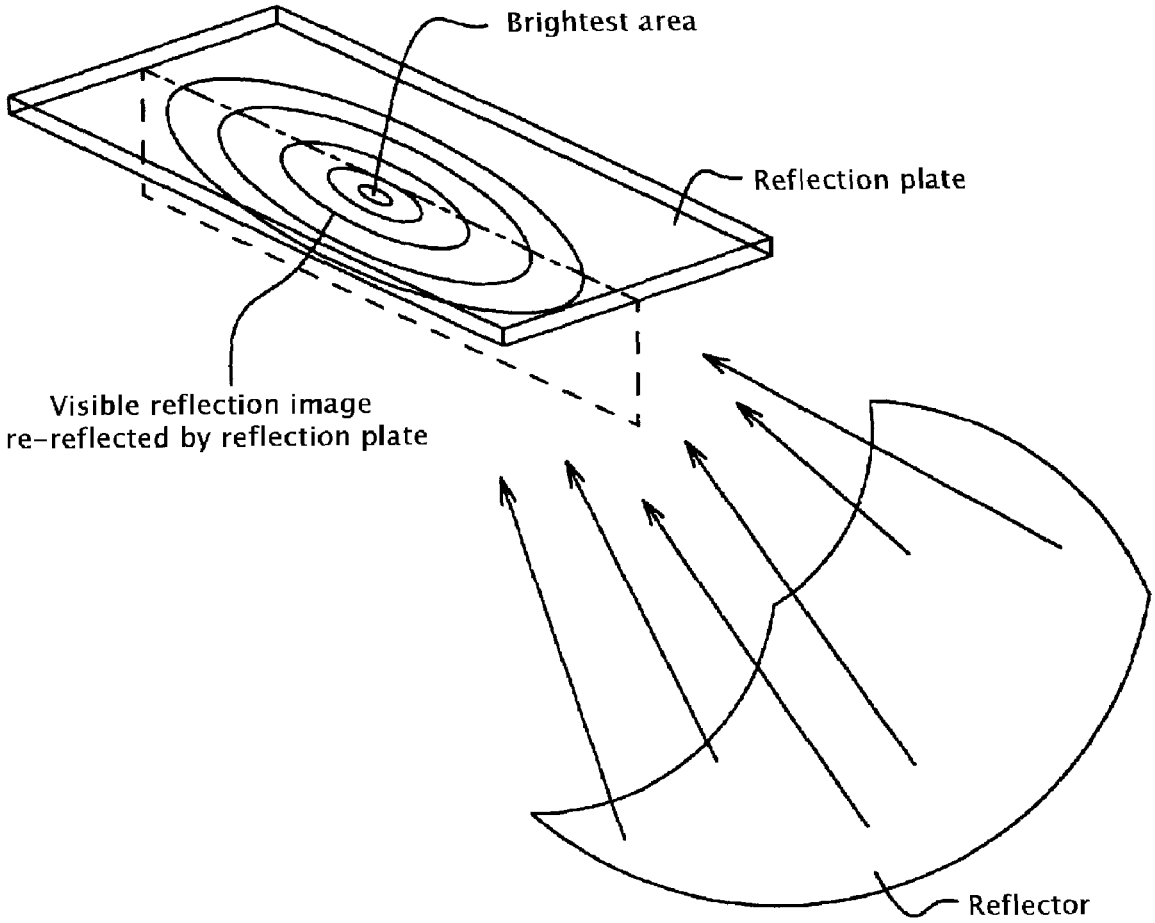
FIG. 10 is a conceptual diagram showing a reflection image formed by the reflector of FIG. 8.

FIG. 10 is a diagram showing a state where the semitransparent virtual screen parallel with the main optical path b of the reflection light is removed from the state shown in FIG. 9. As shown in FIG. 10, when the reflection plate is located near the upper edge of the reflector, substantially all the reflection light from the reflecting surface of the reflector is reflected by the underside of the reflection plate (the bottom side in FIG. 10). As a result, the reflection image re-reflected by the reflection plate is observed as if the original reflection image is inverted and the brightest area (the spot area, the high intensity area) is shifted somewhat downward.

The foregoing describes cases in which an example of a vehicle headlight made in accordance with principles of the disclosed subject matter is applied to a headlight intended for the right side of a vehicle. The disclosed subject matter is not limited thereto, however, and the vehicle headlight of the disclosed subject matter may be applied to a headlight intended for the left side of a vehicle, and to other types of vehicle lights.

While there has been described what are at present considered to be exemplary embodiments of the invention, it will be understood that various modifications may be made thereto, and it is intended that the appended claims cover such modifications as fall within the true spirit and scope of the invention.

What is claimed is:

1. A vehicle headlight arranged to wrap around from a front towards a side of a vehicle, the vehicle headlight configured to selectively provide a low beam illumination and a high beam illumination and having an optical axis configured to extend along a traveling direction of the vehicle, the vehicle headlight comprising:

a light source configured such that a main optical axis of the light source forms an angle of substantially 30° to substantially 60° with respect to the optical axis of the vehicle headlight, and the light source having a longitudinal axis that extends toward a front and first side of the vehicle headlight;

a first reflector having an elliptic reflecting surface with a first focus and a second focus, at least a part of the first reflector being located closer to both the front and an opposite side of the vehicle headlight than is the light source so that an imaginary line that is tangential to a part of a horizontal profile curve of the elliptic reflecting surface is substantially parallel with the main optical axis of the light source, and the light source is located substantially at the first focus of the elliptic reflecting surface;

a second reflector having a reflecting surface configured to collect light from the first reflector and to reflect the light from the first reflector towards the front of the vehicle headlight, the second reflector located closer to both the first side and a rear of the vehicle headlight than is the light source; and a distribution pattern switching unit configured to switch a distribution pattern of light projected from the second reflector between a low beam distribution pattern and a high beam distribution pattern, the distribution pattern switching unit located between the first reflector and the second reflector, wherein the elliptic reflecting surface of the first reflector and the reflecting surface of the second reflector are configured to provide a maximum output during low beam illumination, and the distribution pattern switching unit has a reflecting portion configured to reflect at least a low part of light that, during low beam illumination, is reflected from the first reflector and directed to a lower portion of the low beam distribution pattern, the reflecting portion configured to reflect the low part of light reflected from the first reflector towards a location above a horizontal level during high beam illumination.

2. The vehicle headlight according to claim 1, further comprising:

a third reflector having an elliptic reflecting surface with a first focus and a second focus, the third reflector being located between the first reflector and the second reflector, and wherein the third reflector is arranged such that the light source is located substantially at the first focus of the elliptic reflecting surface of the third reflector and such that light from the third reflector is collected at the second focus of the elliptic reflecting surface of the third reflector.

3. The vehicle headlight according to claim 1, further comprising:

an inner lens configured to diffuse light from the light source, wherein the inner lens is configured such that light that is refracted by and passes through the inner lens is diffused by the inner lens and projected along the optical axis of the vehicle headlight, and light that is reflected by the inner lens is diffused and projected along the optical axis of the vehicle headlight.

4. The vehicle headlight according to claim 3, further comprising:

a third reflector having an elliptic reflecting surface with a first focus and a second focus, the third reflector being located between the first reflector and the second reflector, and wherein the third reflector is arranged such that the light source is located substantially at the first focus of the elliptic reflecting surface of the third reflector and such that light from the third reflector is collected at the second focus of the elliptic reflecting surface of the third reflector and then diffused before passing through the inner lens.

5. The vehicle headlight according to claim 1, further comprising:

a fourth reflector configured to reflect direct light from the light source along the optical axis of the vehicle headlight, the fourth reflector being located closer to the opposite side of the vehicle headlight than the first reflector, and wherein a gap for letting the direct light from the light source pass through is located between the first reflector and the fourth reflector.

6. The vehicle headlight according to claim 2, further comprising:

a fourth reflector configured to reflect direct light from the light source along the optical axis of the vehicle headlight, the fourth reflector being located closer to the opposite side of the vehicle headlight than the first reflector, and wherein a gap for letting the direct light from the light source pass through is located between the first reflector and the fourth reflector.

7. The vehicle headlight according to claim 3, further comprising a fourth reflector configured to reflect direct light from the light source along the optical axis of the vehicle headlight, the fourth reflector being located closer to the opposite side of the vehicle headlight than the first reflector, and wherein a gap for letting the direct light from the light source pass through is located between the first reflector and the fourth reflector.

8. The vehicle headlight according to claim 4, further comprising a fourth reflector configured to reflect direct light from the light source along the optical axis of the vehicle headlight, the fourth reflector being located closer to the opposite side of the vehicle headlight than the first reflector, and wherein a gap for letting the direct light from the light source pass through is located between the first reflector and the fourth reflector.

9. A vehicle headlight having an optical axis extending from a rear side to a front side of the vehicle headlight and located between a first side and an opposite side of the vehicle headlight, comprising:

a light source configured such that a main optical axis of the light source forms an angle with respect to the optical axis of the vehicle headlight, the light source having a longitudinal axis that extends toward the front and first side of the vehicle headlight;

a first reflector having a reflecting surface with a first focus and a second focus, at least a part of the first reflector being located between the light source and the front side of the vehicle headlight, and the first reflector including a portion that extends in parallel with the main optical axis of the light source, and the light source is located substantially at the first focus of the first reflector;

a second reflector having a reflecting surface configured to collect light from the first reflector and to reflect the light from the first reflector towards the front side of the vehicle headlight, the light source being located between the opposite side of the vehicle headlight and the second reflector; and a distribution pattern switching unit including a reflecting portion that is movable between a first position when in low beam mode and a second different position when in high beam mode, the distribution pattern switching unit being located between the first reflector and the second reflector, wherein the reflecting portion is configured to reflect at least part of a low directed light received from the first reflector into an upward direction when the switching unit is in high beam mode, and the reflecting portion is configured to be moved relative to the low directed light so as to permit the low directed light to pass when in low beam mode.

10. The vehicle headlight according to claim 9, further comprising:

a third reflector having an elliptic reflecting surface with a first focus and a second focus, the third reflector being located between the first reflector and the second reflector, and wherein the third reflector is arranged such that the light source is located substantially at the first focus of the elliptic reflecting surface of the third reflector and such that light from the third reflector is collected at the second focus of the elliptic reflecting surface of the third reflector.

11. The vehicle headlight according to claim 9, further comprising:

an inner lens configured to diffuse light from the light source, wherein the inner lens is configured such that light that is refracted by and passes through the inner lens is diffused by the inner lens and projected along the optical axis of the vehicle headlight, and light that is reflected by the inner lens is diffused and projected along the optical axis of the vehicle headlight.

12. The vehicle headlight according to claim 11, further comprising:

a third reflector having an elliptic reflecting surface with a first focus and a second focus, the third reflector being located between the first reflector and the second reflector, and wherein the third reflector is arranged such that the light source is located substantially at the first focus of the elliptic reflecting surface of the third reflector and such that light from the third reflector is collected at the second focus of the elliptic reflecting surface of the third reflector and then diffused before passing through the inner lens.

13. The vehicle headlight according to claim 9, further comprising:

a fourth reflector configured to reflect direct light from the light source along the optical axis of the vehicle headlight, the fourth reflector being located closer to the opposite side of the vehicle headlight than the first reflector, and wherein a gap for letting the direct light from the light source pass through is located between the first reflector and the fourth reflector.

14. A vehicle headlight having an optical axis extending from a rear side to a front side of the vehicle headlight and located between a first side and an opposite side of the vehicle headlight, comprising:

a light source configured such that a main optical axis of the light source forms an angle with respect to the optical axis of the vehicle headlight, the light source having a longitudinal axis that extends toward the front and first side of the vehicle headlight;

a first reflector having a reflecting surface with a first focus and a second focus, at least a part of the first reflector being located between the light source and the front side of the vehicle headlight, the first reflector including a portion that extends in parallel with the main optical axis of the light source, and the light source being located substantially at the first focus of the first reflector;

a second reflector having a reflecting surface configured to collect light from the first reflector and to reflect the light from the first reflector towards the front side of the vehicle headlight, the light source being located between the opposite side of the vehicle headlight and the second reflector; and means for switching between a low beam light distribution and a high beam light distribution by redirecting light from the low beam light distribution to an upper portion of the low beam light distribution to form the high beam light distribution.

15. The vehicle headlight according to claim 14, further comprising:

a third reflector having an elliptic reflecting surface with a first focus and a second focus, the third reflector being located between the first reflector and the second reflector, and wherein the third reflector is arranged such that the light source is located substantially at the first focus of the elliptic reflecting surface of the third reflector and such that light from the third reflector is collected at the second focus of the elliptic reflecting surface of the third reflector.

16. The vehicle headlight according to claim 14, further comprising:

an inner lens configured to diffuse light from the light source, wherein the inner lens is configured such that light that is refracted by and passes through the inner lens is diffused by the inner lens and projected along the optical axis of the vehicle headlight, and light that is reflected by the inner lens is diffused and projected along the optical axis of the vehicle headlight.

17. The vehicle headlight according to claim 16, further comprising:

a third reflector having an elliptic reflecting surface with a first focus and a second focus, the third reflector being located between the first reflector and the second reflector, and wherein the third reflector is arranged such that the light source is located substantially at the first focus of the elliptic reflecting surface of the third reflector and such that light from the third reflector is collected at the second focus of the elliptic reflecting surface of the third reflector and then diffused before passing through the inner lens.

18. The vehicle headlight according to claim 14, further comprising:

a fourth reflector configured to reflect direct light from the light source along the optical axis of the vehicle headlight, the fourth reflector being located closer to the opposite side of the vehicle headlight than the first reflector, and wherein a gap for letting the direct light from the light source pass through is located between the first reflector and the fourth reflector.

* * * * *